US010221652B2

(12) United States Patent
Inglis et al.

(10) Patent No.: US 10,221,652 B2
(45) Date of Patent: Mar. 5, 2019

(54) DOWNHOLE BALL VALVE

(71) Applicant: Halliburton Energy Services, Inc., Houston, TX (US)

(72) Inventors: Peter Derek Walter Inglis, Tayside (GB); Gordon Kenneth Scott, Lothian (GB); Ralph H. Echols, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 137 days.

(21) Appl. No.: 15/115,158

(22) PCT Filed: Jul. 25, 2014

(86) PCT No.: PCT/US2014/048189
§ 371 (c)(1),
(2) Date: Jul. 28, 2016

(87) PCT Pub. No.: WO2016/014075
PCT Pub. Date: Jan. 28, 2016

(65) Prior Publication Data

US 2016/0348469 A1 Dec. 1, 2016

(51) Int. Cl.
*E21B 34/06* (2006.01)
*E21B 34/00* (2006.01)
*E21B 33/10* (2006.01)

(52) U.S. Cl.
CPC ..... *E21B 34/063* (2013.01); *E21B 33/10* (2013.01); *E21B 2034/002* (2013.01)

(58) Field of Classification Search
CPC ..... E21B 34/06; E21B 34/063; E21B 33/10; E21B 2034/002; E21B 23/04; E21B 41/00; Y10T 428/12104; Y10T 156/10
See application file for complete search history.

(56) References Cited

U.S. PATENT DOCUMENTS 7,559,358 B2 7/2009 DiFoggio et al.
8,201,632 B2 6/2012 Burnett
(Continued)

FOREIGN PATENT DOCUMENTS

WO WO 2012/143775 A1 7/2012
WO WO 2012/143775 A2 10/2012
WO WO 2014/042622 A1 3/2014

OTHER PUBLICATIONS

Baker Hughes, "Subsurface Safety Systems," Published in 2013, 3 pages.

(Continued)

*Primary Examiner* — Yong-Suk Ro
(74) *Attorney, Agent, or Firm* — Benjamin Fite; Parker Justiss, P.C.

(57) ABSTRACT

A downhole ball valve includes a housing that includes a tubular member; a ball seat positioned in the tubular member, the ball seat including a sealing surface; and a ball that includes a first hemispherical portion, a second hemispherical portion, and a bore that extends through the ball between the first and second hemispherical portions. The ball is adjustable between a closed position with the first hemispherical portion sealingly engaged with the sealing surface of the ball seat to close the bore to fluid communication with the tubular member, and an open position with the bore at least partially in fluid communication with the tubular member. The first hemispherical portion includes a first material, and at least a portion of the second hemispherical portion that extends from a surface of the ball towards the bore of the ball includes a second material different than the first material.

16 Claims, 5 Drawing Sheets

(56) References Cited

U.S. PATENT DOCUMENTS

| | | | |
|---|---|---|---|
| 2009/0065213 | A1 | 3/2009 | Burnett |
| 2010/0101803 | A1 | 4/2010 | Clayton et al. |
| 2011/0284232 | A1 | 11/2011 | Huang |
| 2012/0260991 | A1 | 10/2012 | Inglis et al. |
| 2013/0048304 | A1 | 2/2013 | Agrawal et al. |
| 2013/0068474 | A1 | 3/2013 | Hofman et al. |
| 2014/0096963 | A1 | 4/2014 | Sharma et al. |
| 2015/0308239 | A1 | 10/2015 | Langlais et al. |
| 2015/0315870 | A1 | 11/2015 | Kalb et al. |
| 2016/0115368 | A1 | 4/2016 | Sadana et al. |

OTHER PUBLICATIONS

Itf Energy, "PowerBall—Red Spider," 0.3, published on or before 2012, 2 pages.

PCT International Search Report and Written Opinion of the International Searching Authority, PCT/US2014/048189, dated Apr. 22, 2015, 20 pages.

Schlumberger, "Fortress," copyright 2011, 2 pages.

DOWNHOLE BALL VALVE

CROSS-REFERENCE TO RELATED APPLICATIONS

This application is a U.S. National Phase Application under 35 U.S.C. § 371 and claims the benefit of priority to International Application Serial No. PCT/US2014/048189, filed on Jul. 25, 2014, the contents of which are hereby incorporated by reference.

TECHNICAL BACKGROUND

This disclosure relates to a ball valve and, more particularly, to a downhole ball valve that includes a ball made of two or more different materials.

BACKGROUND

Wellbores are sometimes drilled into subterranean formations containing hydrocarbons to allow recovery of the hydrocarbons. During the drilling and production of a hydrocarbon bearing formation, various procedures may be performed that involve temporarily isolating fluid flowing between the surface of a wellbore and the formation through a wellbore tubular. Such procedures can include flow control operations, completion operations, and/or interventions. Various valves, including ball valves, may be used during these procedures to control the flow of fluid through the wellbore tubular. Ball valves generally include a ball seat for receiving a sealing ball. In some situations, ball valves may fail during use, which may reduce the ability to establish fluid communication between the surface of the wellbore and the formation through the wellbore tubular. In some instances, should the ball become stuck in a closed position, the only way to gain access to the reservoir below the ball is to mill the ball.

DETAILED DESCRIPTION

The present disclosure relates to a downhole ball valve that includes a ball that is made of a particular material and includes one or more portions that are made of a different material that is more easily bored, milled, or otherwise cut as compared to the particular material from which the ball is made. Such portions may be positioned in the ball so as to form a boreable or millable path through the ball to establish fluid communication through the valve even when the valve is in the closed position.

Various implementations of a downhole ball valve according to the present disclosure may include none, one or some of the following features. For example, the downhole ball valve may reduce rig and/or work time in the case of a "fail closed" situation where the valve may need to be milled (e.g., bored, cut, or otherwise milled) through to achieve fluid communication there through. As another example, the downhole ball valve may be able to withstand design wellbore pressures while also allowing mill through capability in the case of a fail closed situation. In another example, the downhole ball valve may facilitate a centralizing of a mill through when milling (or boring or cutting or dissolving) through particular portions of the ball.

Figure 1:
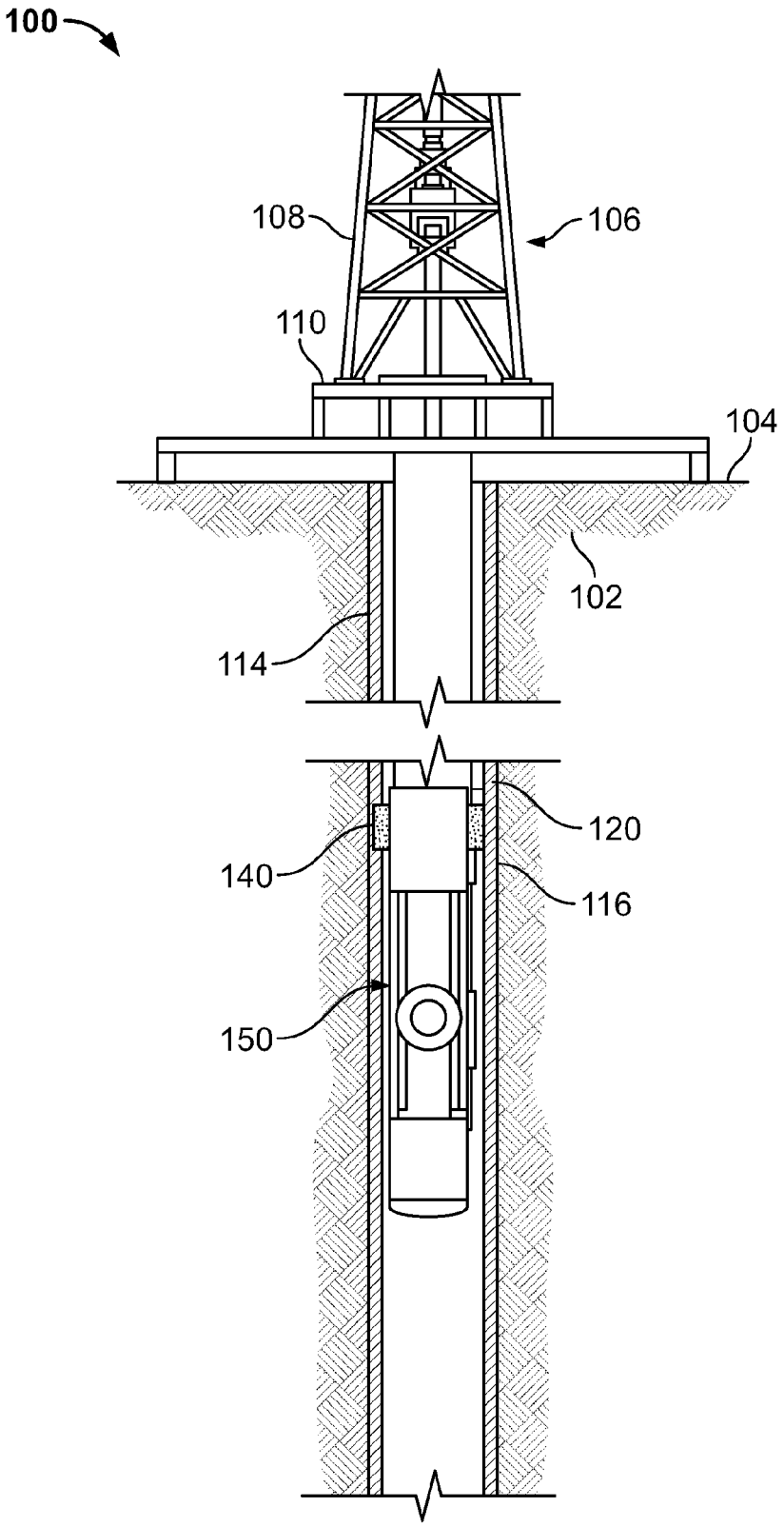
FIG. 1 illustrates a cross-section view of an example well system that includes a downhole ball valve.

FIG. 1 illustrates a cross-section view of an example well system 100 that includes a downhole ball valve 150. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The illustrated wellbore 114 extends substantially vertically away from the earth's surface 104 over a vertical wellbore portion 116 and an annulus 112 is defined between the wellbore 114 and the tubing string 120 (and other downhole tools in the wellbore 114). In alternative operating environments, all or portions of the wellbore 114 may be vertical, deviated at any suitable angle, horizontal, and/or curved. The wellbore 114 may be a new wellbore, an existing wellbore, a straight wellbore, an extended reach wellbore, a sidetracked wellbore, a multilateral wellbore, and other types of wellbores for drilling and completing one or more production zones. Further the wellbore 114 may be used for both producing wells and injection wells, and may be completely cased, partially cased, or open hole (e.g., uncased).

A wellbore tubular string 120 that includes the ball valve 150 may be lowered into the subterranean formation 102 for a variety of purposes (e.g., injecting or producing fluids from the wellbore, workover or treatment procedures, etc.) throughout the life of the wellbore 114. The implementation shown in FIG. 1 illustrates the wellbore tubular 120 in the form of a production tubing string that includes a packer 140 disposed in the wellbore 114. The wellbore tubular 120 that includes the ball valve 150 is equally applicable to any type of wellbore tubular being inserted into a wellbore as part of a procedure needing fluid isolation from above or below the ball valve, including as non-limiting examples drill pipe, segmented pipe, casing, rod strings, and coiled tubing. Further, techniques of isolating the interior of the wellbore tubular string 120 from the annular region between the wellbore tubular string 120 and the wellbore wall 114 may take various forms. For example, a zonal isolation device such as a packer (e.g., packer 140), may be used to isolate the interior of the wellbore tubular string 120 from the annular region to allow for the ball valve 150 to control the flow of a fluid through the wellbore tubular 120. In some implementations, the wellbore tubular string 120 that includes the ball valve 150 may be used without any additional zonal isolation device (e.g., a packer).

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for extending the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 comprising the ball valve 150 within a land-based wellbore 114, in alternative implementations, mobile workover rigs, wellbore servicing units (such as coiled tubing units), and the like may be used to lower the wellbore tubular 120 comprising the ball valve 150 into the wellbore 114. The wellbore tubular 120 comprising the ball valve 150 may alternatively be used in other operational environments, such as within an offshore wellbore operational environment.

Regardless of the type of operational environment in which the ball valve 150 is used, the ball valve 150 comprises a flow through device that serves to control a flow of fluid from the surface to a formation (and vice-versa) through a tubular or conduit, including situations in which the ball valve 150 fails to actuate (e.g., fails to open or be adjusted from a closed position). As described in greater detail with reference to FIGS. 2-3, the ball valve 150 includes a ball that is made of a particular material based on, for example, pressure requirements to seal the valve 150 against flow in the closed position. The ball of the valve 150 may also include portions that are made of a different material that is more easily bored, milled, or otherwise cut as compared to the particular material from which the ball is made. Such portions may be positioned in the ball so as to form a boreable or millable path through the ball to establish fluid communication through the valve 150 even when the valve 150 is in the closed position. In some implementations, a path may be formed through the ball by dissolving (e.g., with an acid or chemical) a portion of the ball.

The ball valve 150 may also comprise components (e.g., a threaded connection) located above or below the ball valve 150 to allow the ball valve 150 to be disposed within and/or coupled to a wellbore tubular and/or other wellbore components (e.g., production subs, downhole tools, screens, etc.), for example, to form a workstring, production string, conveyance string, etc. While the following discussion describes a wellbore tubular 120 with a ball valve 150, it should be understood that any plurality of ball valves 150 comprising the flow through device may be used in one or more wellbore tubular 120 strings to achieve the results and advantages described herein.

Figure 2:
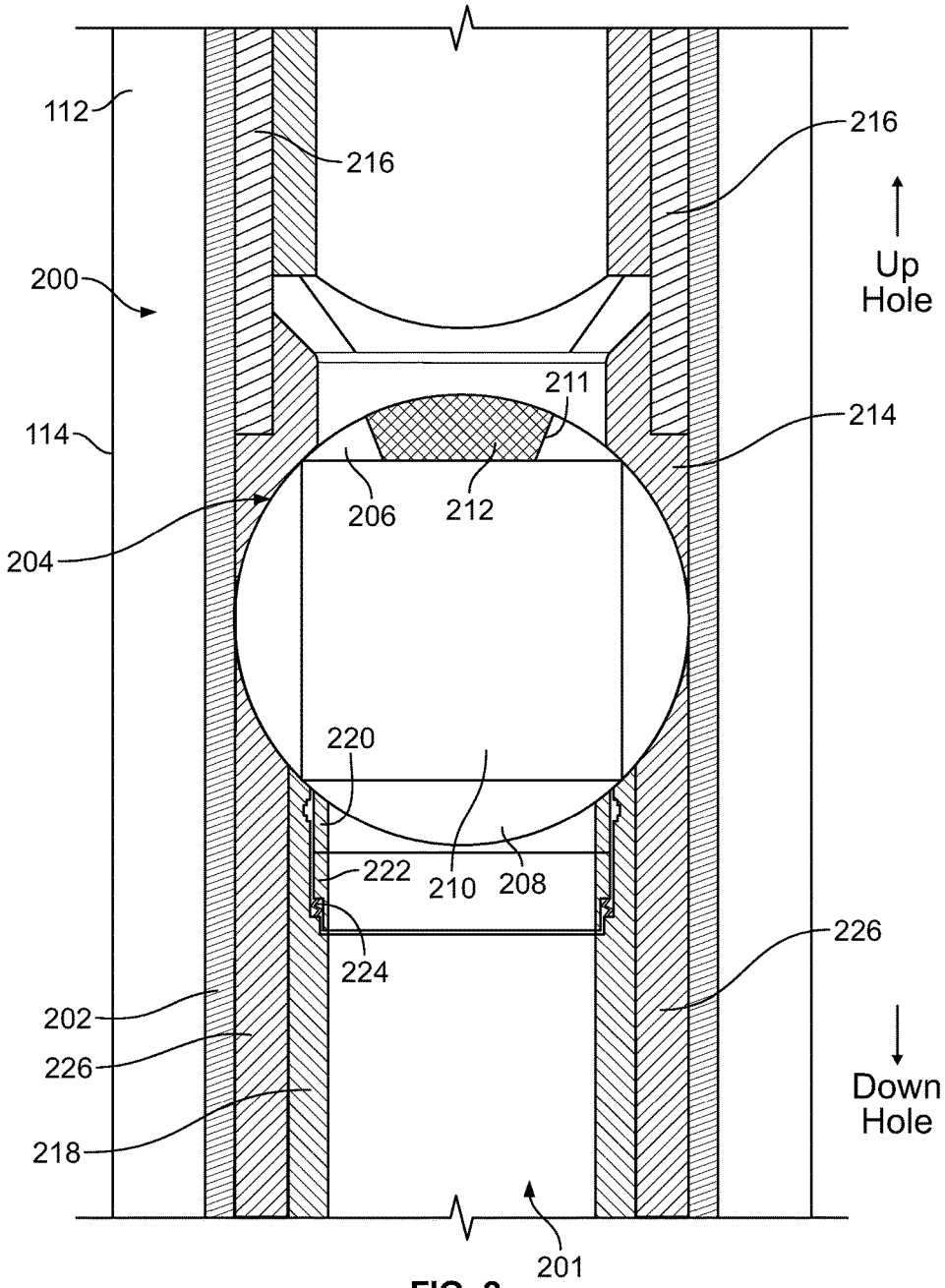
FIG. 2 illustrates a cross-section view of a portion of an example downhole ball valve.

FIG. 2 illustrates a cross-section view of a portion of an example downhole ball valve 200, which, in some aspects, may be used as the ball valve 150 in the system 100. FIG. 2 illustrates the valve 200 within the wellbore 114, and in a closed position, e.g., with a bore 210 of a ball 204 of the valve 200 turned orthogonal to a throughbore 201 of the valve 200. In an open position (not shown), the bore 210 of the ball 204 may be turned to align (e.g., completely, substantially, or partially) with the throughbore 201 to allow fluid communication through the valve 200.

The illustrated valve 200 includes a tubular housing 202 that may be coupled (e.g., threadingly) to other downhole components, in a downhole string or otherwise, that are uphole and/or downhole of the valve 200. In the illustrated implementation, the housing 202 is a single piece tubular component that encloses other components of the valve 200 therein.

The valve 200 also includes, as illustrated, trunnion forks 216 that are positioned radially within an uphole portion of the housing 202 and are coupled to a debris wiper housing 214. The debris wiper housing 214 helps ensure that particles in a flow of fluid through the valve 200 do not interfere with operation (e.g., rotation) of the ball 204 within the housing 202. Further, the debris wiper housing 214 may form an interface with an upper face portion 206 of the ball 204 when the valve 200 is in the closed position, thereby minimizing fluid flow between the ball 204 and the housing 202 as well as preventing (all or substantially) debris ingress.

On the downhole side of the ball 204, lower trunnion supports 226 are positioned radially within a downhole portion of the housing 202 and may form an interface with a lower face portion 208 of the ball 204 when the valve 200 is in the closed position, thereby minimizing fluid flow between the ball 204 and the housing 202 and/or minimizing debris ingress. In the illustrated implementation of the valve 200, an outer seat 218 also provides a sealing surface with the lower face portion 208 of the ball 204 when the valve 200 is in the closed position. In this implementation, an inner seat 220 is positioned radially within the outer seat 218 and also provides a sealing surface with the lower face portion 208 of the ball 204 when the valve 200 is in the closed position.

The illustrated valve 200 also includes a spring guide 222 also mounted on a downhole side of the inner seat 220, radially within the outer seat 218, and formed to shoulder out against the outer seat 218. A spring 224 (or springs) is positioned axially between the spring guide 222 and the outer seat 218 to bias the spring guide 222 in an uphole direction and against the inner seat 220. The spring 224 may be wave springs, compression springs, Bellville washers, or otherwise, and may pre-load the inner seat 220 against the lower face portion 208 of the ball 204. For example, in some cases, the valve 200 may be operated in an environment where a high pressure fluid acts on the lower face portion 208 of the ball, while the upper face portion 206 of the ball 204 may have a much lower pressure applied thereto. Thus, the seating system (e.g., the inner and outer seats) may need to seal against the higher pressure fluid on the lower face portion 208, and the lower face portion 208 may be made of a material that can withstand such higher pressure fluids.

As shown in FIG. 2, the upper face portion 206 of the ball 204 includes a hole 211 that is formed (e.g., bored, milled, or otherwise cut) from the upper face portion 206. In the illustrated implementation, the hole 211 is shaped to approximate a truncated cone with a rounded bottom (e.g., that coincides with an outer surface of the upper face portion 206). In some aspects, the hole 211 may extend from the outer surface of the upper face portion 206 to the bore 210. In alternative aspects, the hole 211 may extend from the outer surface of the upper face portion 206 toward the bore 210, but may not reach the bore 210.

The hole 211, in the illustrated implementation, is filled with a particular material 212 (e.g., bronze, brass, a non-metallic composite, or otherwise) that is different than a material (e.g., nickel-chrome alloy or superalloy, titanium, or otherwise) from which the ball 204 is formed. The material 212 may be softer, more brittle, more frangible, or otherwise more easily milled, bored, or otherwise cut relative to the material of the ball 204. In the illustrated implementation of FIG. 2, for instance, all of the lower face portion 208 may be made of the ball material, while only a portion of the upper face material 208, such as the portion that surrounds the hole 211, is made of the ball material.

Although particular components of the illustrated valve 200 are shown in FIG. 2, this implementation is for illustrative purposes, and other types or constructions of ball valves that include a ball such as the ball 204, are within the scope of the present disclosure. For example, although the valve 200 includes two seats (an inner seat 220 and an outer seat 218), other implementations may include only a single seat (or may include more than two seats).

Figure 3:
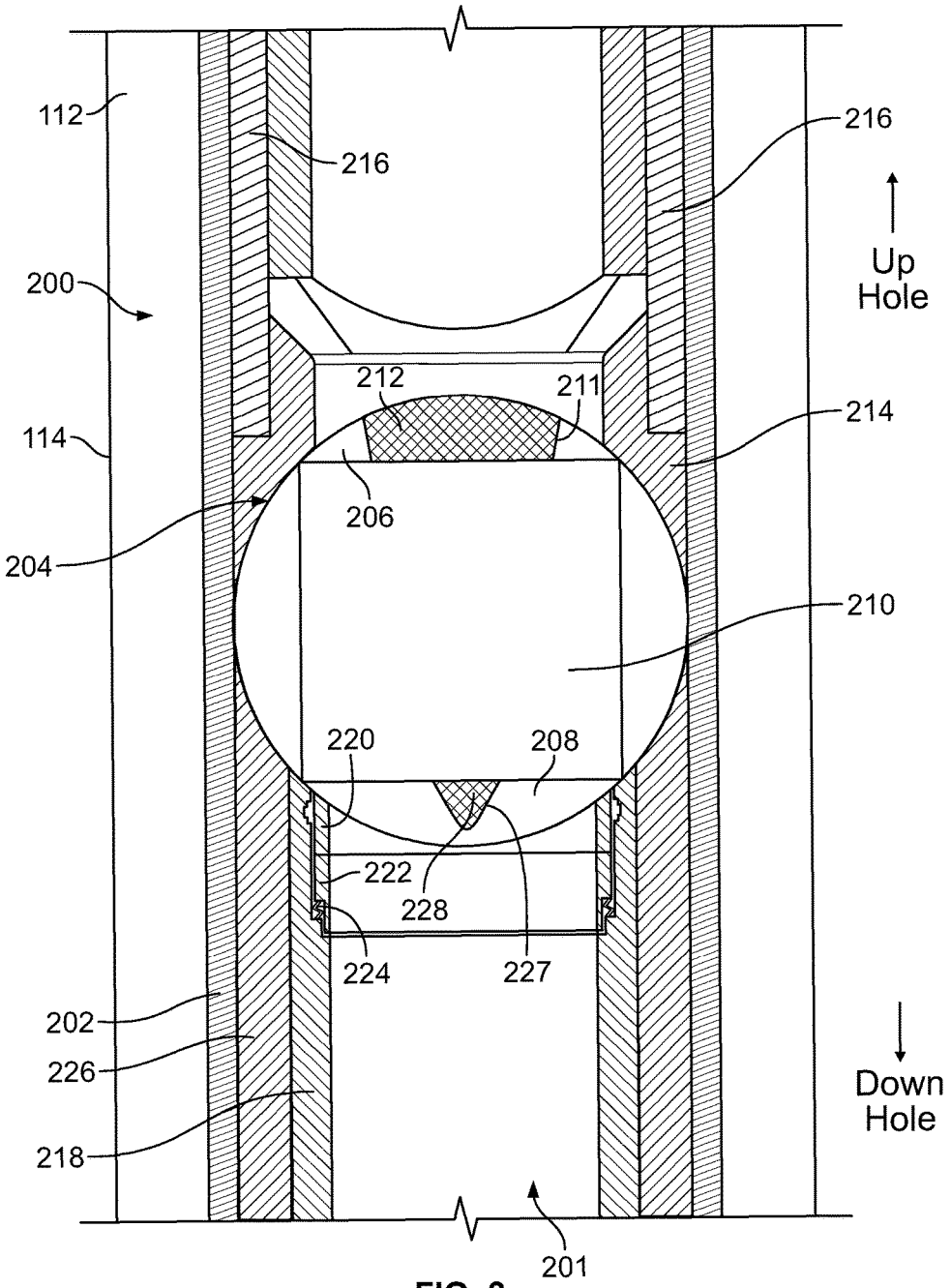
FIG. 3 illustrates a cross-section view of a portion of another example downhole ball valve.

FIG. 3 illustrates a cross-section view of a portion of another example of the downhole ball valve 200. In the implementation of the valve 200 shown in FIG. 3, the lower face portion 208 of the ball 204 also includes a hole 227 formed (e.g., drilled, bored, milled) therein. The hole 227, in the illustrated implementation, is filled with a particular material 228 (e.g., bronze, brass, a non-metallic composite, or otherwise) that is different than the material (e.g., nickel-chrome alloy or superalloy, titanium, or otherwise) from which the ball 204 is formed. The material 228 may be softer, more brittle, more frangible, or otherwise more easily milled, bored, or otherwise cut relative to the material of the ball 204.

In the illustrated implementation of FIG. 3, the hole 227 is shaped to approximate a cone or rough pyramid with a "top" surface that defines the bore 210. The illustrated hole 227 extends from the bore in a downhole direction (when the valve is closed) towards an outer surface of the lower face portion 208 of the ball 204. As shown, however, the hole 227 does not extend to meet the outer surface of the lower face portion 208 of the ball 204, thereby leaving at least a layer of the material from which the ball 204 is made between the bore 210 and the throughbore 201 (when the valve 200 is closed).

As illustrated in FIG. 3, the portions of the ball 204 that are filled with the more millable or boreable material (e.g., the holes 211 and 227) are arranged so as to provide a relatively centralized fluid path through the ball 204 (orthogonal to the bore 210) once milled or bored out. Thus, in the case of the valve 200 failing in a closed position, fluid communication may be established through the ball 204, and therefore through the valve 200, even though the valve 200 is in the closed position. In some aspects, by including the more millable or boreable material arranged as illustrated, milling of a fluid path through the ball 204 may be more efficiently accomplished as compared to a ball of the valve 200 that is made of a single material that can withstand downhole fluid pressure during normal operation.

Figure 4:
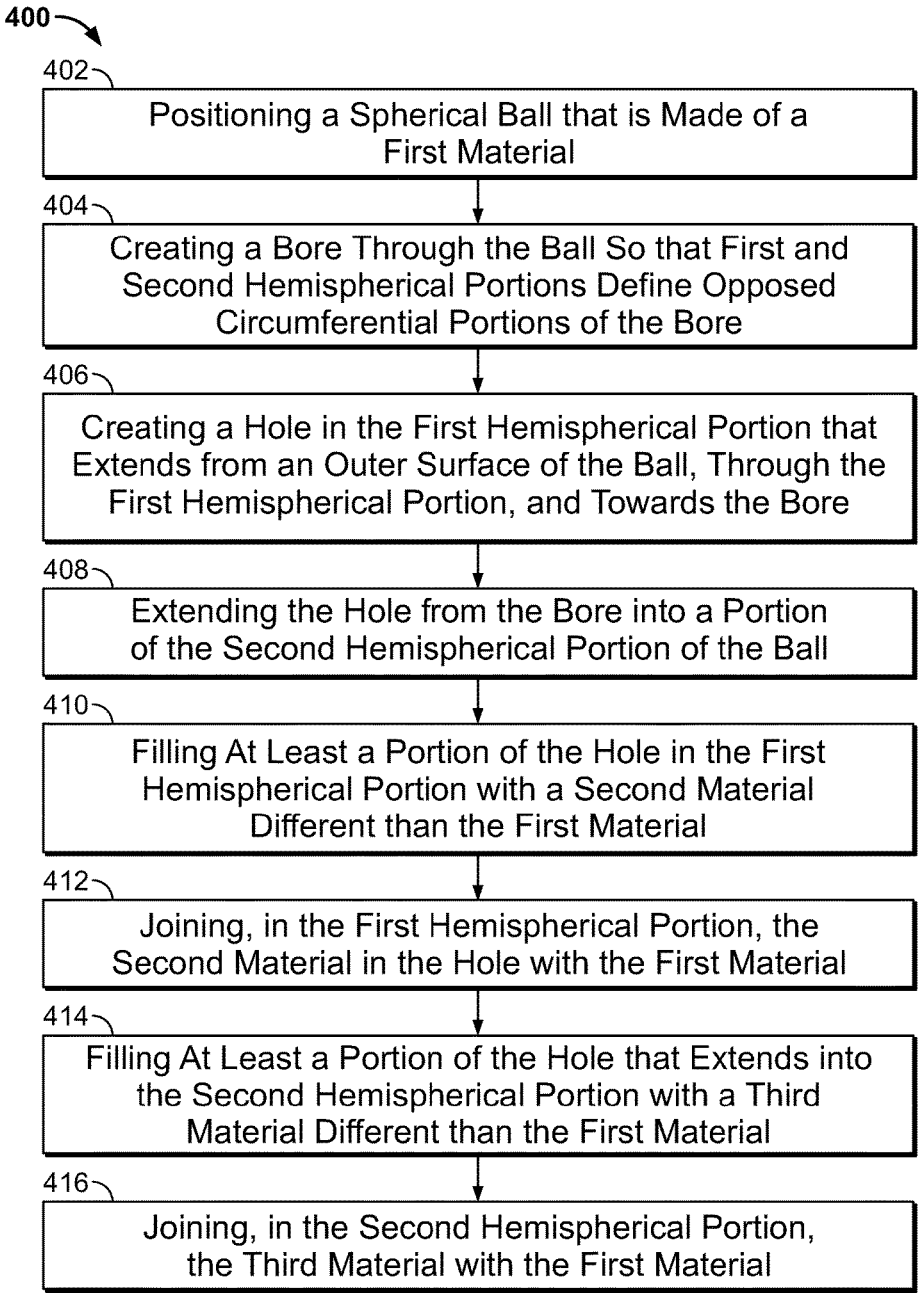
FIG. 4 illustrates a flow chart of an example process for making a ball of a downhole ball valve.

FIG. 4 illustrates a flow chart of an example process 400 for making a ball of a downhole ball valve. In some implementations, process 400 may be implemented, for example, to make the ball 204 as shown in either of FIGS. 2 and/or 3. Process 400, however, may also be used to make a ball of a downhole ball valve other than the valve 200 shown in these figures. Further, although process 400 is described as having steps in a particular order, some steps may be performed out of the illustrated order as described below. Further, some steps may be omitted, or some steps may be added, without departing from the scope of the present disclosure.

Process 400 can begin at step 402, which includes positioning a spherical ball that is made of a first material in a position to be worked upon. The spherical ball may be completely spherical or partially spherical (e.g., a globe with flat pole areas). For example, in some instances, the ball, when positioned, may have particular surfaces milled, ground, or otherwise flattened to create pole areas of the ball. The ball can be made of a particular material, such as for example, Inconel™, a nickel-chromium alloy, titanium, or other material appropriate for the operation of the ball valve. For instance, in some cases, the ball material may be chosen based on a downhole pressure or pressure range of fluids in a wellbore during the valve operation. The ball, for instance, may have a particular fluid pressure applied to a particular portion of the ball (e.g., a downhole portion or high pressure side) when the valve is in the closed position, while another portion of the ball (e.g., an uphole portion or low pressure side) may have a much lower pressure applied in the closed position.

Process 400 may continue at step 404, which includes creating a bore through the ball so that first and second hemispherical portions define opposed circumferential portions of the bore. The bore can be cylindrically formed through the ball to, for instance, facilitate fluid communication or flow through the ball valve when in operation, and in an open position. In some instances, the bore may be drilled, milled, or otherwise cut from the ball. By forming the bore, the first and second hemispherical portions may be formed that define the bore. Here, the hemispherical portions may be completely or substantially hemispherical in shape, or may approximate a hemispherical shape. The hemispherical portions may also refer to different, and opposing, portions of the ball (e.g., a low pressure side and a high pressure side) when the valve is in a closed position.

Process 400 may continue at step 406, which includes creating a hole in the first hemispherical portion that extends from an outer surface of the ball, through the first hemispherical portion, and towards the bore. The hole may be bored, milled, or otherwise cut from the first hemispherical portion. One example of a hole is shown in FIGS. 2-3 as the hole 211. In some implementations, the hole may be formed over a relatively large surface area of the first hemispherical portion of the ball extend, in a narrowing trajectory, towards the bore. For example, the hole may resemble or approximate a truncated cone.

Process 400 may continue at step 408, which includes extending the hole from the bore into a portion of the second hemispherical portion of the ball. One example of the hole that extends into the second hemispherical portion is shown in FIG. 3 as the hole 227. In some implementations, the extended hole may be formed as, or approximate, a conic shape that extends toward (but does not reach) an outer surface of the ball (e.g., on a high pressure side of the ball). In some aspects, steps 406 and 408 may be performed concurrently. In some aspects, steps 406 and 408 (or just step 406) may be performed prior to step 404 (e.g., before the bore is created through the ball).

Process 400 may continue at step 410, which includes filling at least a portion of the hole in the first hemispherical portion. The hole can be filled with a material that is different than the material from which the ball is made. For example, the material filled in the hole in the first hemispherical portion may be bronze, brass, cast iron, or other material (e.g., non-metallic composites, other metals, or otherwise). In some implementations, the material filled in the hole is softer, more brittle, or otherwise more easily milled, bored, or otherwise cut as compared to the material from which the ball is made.

Process 400 may continue at step 412, which includes joining, in the first hemispherical portion, the second material in the hole with the first material. In some implementations, the joining process may include a sintering process, a welding process, or a soldering process to name a few examples. In some alternative implementations, the joining process may include a cryogenics process. In any event, the joining process, in some examples, may depend on the two (or more) different materials from which the ball is made and the hole is filled, respectively. The joining process, for instance, should be appropriate to structurally join the differing materials to provide an integral or rigid ball.

Process 400 may continue at step 414, which includes filling at least a portion of the hole that extends into the second hemispherical portion with another material that is different than the material from which the ball is made. In some aspects, the material that is used to fill the hole in the first hemispherical portion is the same as the material that is used to fill the hole in the second hemispherical portion. In alternative aspects, the material that is used to fill the hole in the first hemispherical portion is different than the material that is used to fill the hole in the second hemispherical portion, but both materials may be softer, more brittle, or otherwise more easily milled, bored, or otherwise cut as compared to the material from which the ball is made.

Process 400 may continue at step 416, which includes joining, in the second hemispherical portion, the material that fills the hole that extends into the second hemispherical portion with the material from which the ball is made. As with step 412, in some implementations, the joining process of step 416 may include a sintering process, a welding process, or a soldering process to name a few examples. In some alternative implementations, the joining process may include a cryogenics process.

In some aspects, steps 414 and 410 are performed simultaneously (e.g., or substantially simultaneously), as the hole that extends through the first hemispherical portion and into the second hemispherical portion of the ball is filled in a single step. Further, once the hole is filed in the single step, steps 412 and 416 may be performed simultaneously (e.g., or substantially simultaneously). In some aspects, once the material in the hole is joined to the material of the ball, step 404 may be performed.

Figure 5:
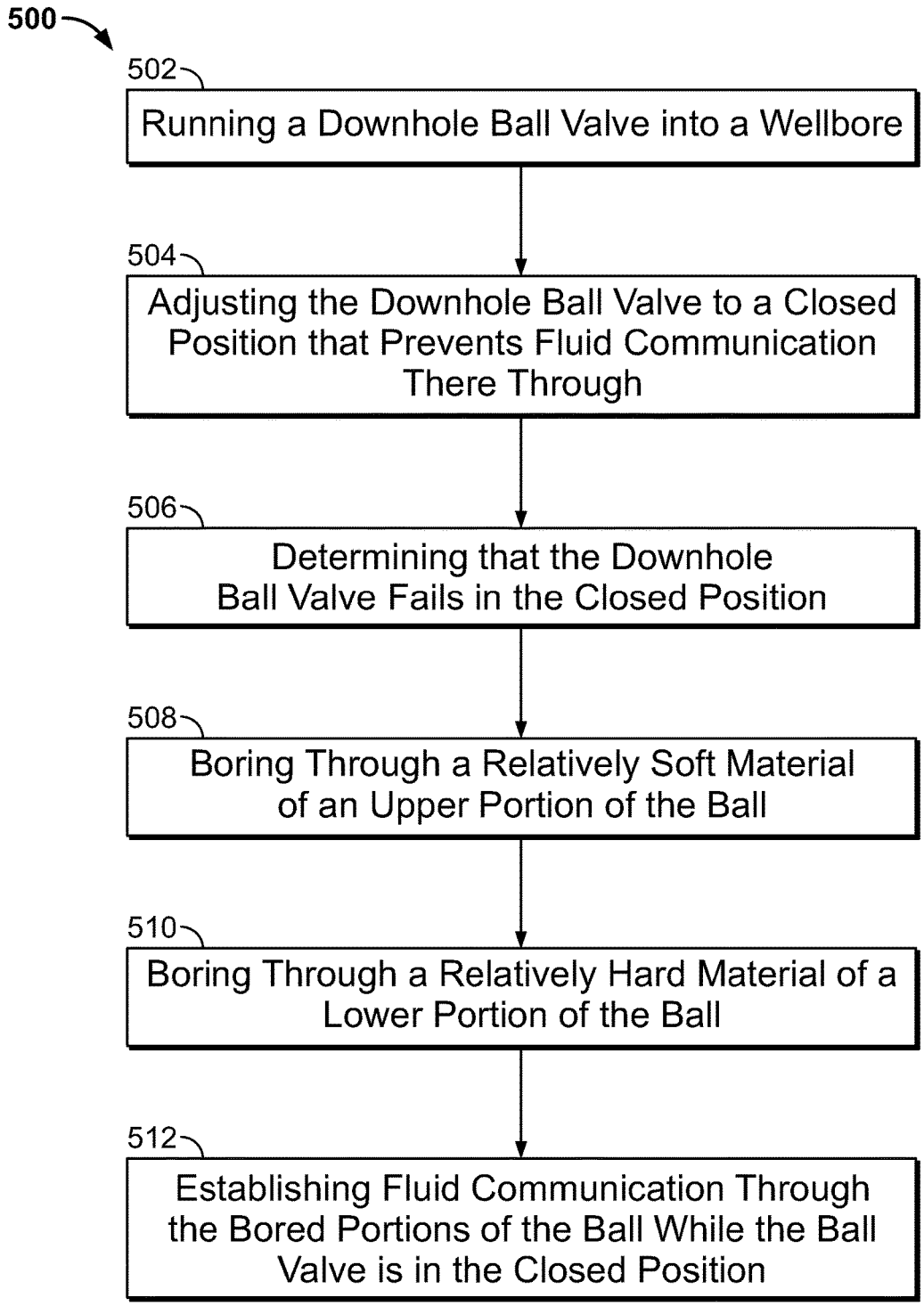
FIG. 5 illustrates a flow chart of an example process for using a downhole ball valve that includes a ball made by a process such as that illustrated in FIG. 4.

FIG. 5 illustrates a flow chart of an example process 500 for using a downhole ball valve that includes a ball made by a process such as that illustrated in FIG. 4 (or another process). In some implementations, process 500 may be implemented, for example, with the ball valve 200 as shown in either of FIGS. 2 and/or 3. Process 500, however, may also be implemented with a downhole ball valve other than the valve 200 shown in these figures. Further, although process 500 is described as having steps in a particular order, some steps may be performed out of the illustrated order. Further, some steps may be omitted, or some steps may be added, without departing from the scope of the present disclosure.

Process 500 can begin at step 502, which includes running a downhole ball valve into a wellbore (e.g., on a tubular, wireline, slickline, coiled tubing, or otherwise). The downhole ball valve, such as the valve 200, can include a ball that includes a first hemispherical portion, a second hemispherical portion, and a bore that extends through the ball between the first and second hemispherical portions. The first hemispherical portion includes a first material, and at least a portion of the second hemispherical portion that extends from a surface of the ball towards the bore of the ball includes a second material that is different than the first material.

Process 500 may continue at step 504, which includes adjusting the downhole ball valve to a closed position that prevents fluid communication there through. Step 504, for instance, may be performed when the ball valve is at a particular depth in the wellbore, after or before a particular downhole operation is or will be performed, or otherwise. The downhole ball valve may be adjusted into the closed position by any appropriate technique, such as mechanically, electrically, hydraulically, or otherwise. In the closed position, the first hemispherical portion may be on a downhole side of the valve (e.g., a high pressure side), while the second hemispherical portion may be on an uphole side of the valve (e.g., a low pressure side). In some aspects, step 504 may be performed before the downhole ball valve is run into the wellbore, e.g., the valve is run in the wellbore in a closed position.

Process 500 may continue at step 506, which includes determining that the downhole ball valve fails in the closed position. For instance, in some cases, the downhole ball valve may be adjusted between open and closed one or more times, but may fail in a closed position (e.g., unable to rotate the ball so that the bore permits fluid communication therethrough). In some cases, the valve may be purposefully adjusted to a locked, closed position but wellbore circumstances may require the valve to be re-opened.

Process 500 may continue at step 508, which includes boring through a relatively soft material of an upper portion of the ball, such as the second hemispherical portion of the ball. The relatively soft material may be the second material, and may be softer, more brittle, or otherwise more easily bored relative to the first material.

Process 500 may continue at step 510, which includes boring through a relatively hard material of a lower portion of the ball, such as the first hemispherical portion of the ball. The relatively hard material may be the first material, and may be harder, more malleable, or otherwise less easily bored relative to the second material. In some examples, the first material may be a non-corrosive steel, Inconel™, another nickel-chromium alloy, or otherwise, and the second material may be brass, bronze, or other material. In some example implementations, the first hemispherical portion (e.g., a high pressure portion of the ball) may include a portion that is made of the second material. In such cases, step 510 may also include boring through the relatively soft material of the high pressure portion of the ball, and then boring through the relatively hard material of the high pressure portion of the ball.

Process 500 may continue at step 512, which includes establishing fluid communication through the bored portions of the ball while the ball valve is in the closed position.

Various implementations have been described in the present disclosure. In an example implementation, a downhole ball valve includes a housing that includes a tubular member; a ball seat positioned in the tubular member, the ball seat including a sealing surface; and a ball that includes a first hemispherical portion, a second hemispherical portion, and a bore that extends through the ball between the first and second hemispherical portions. The ball is adjustable between a closed position with the first hemispherical portion sealingly engaged with the sealing surface of the ball seat to close the bore to fluid communication with the tubular member, and an open position with the bore at least partially in fluid communication with the tubular member. The first hemispherical portion includes a first material, and at least a portion of the second hemispherical portion that extends from a surface of the ball towards the bore of the ball includes a second material different than the first material.

In a first aspect combinable with the general implementation, the portion of the second hemispherical portion of the ball extends through the second hemispherical portion from the surface of the ball to the bore of the ball.

In a second aspect combinable with any of the previous aspects, the portion of the second hemispherical portion of the ball approximates a truncated cone or fulcrum of a cone.

In a third aspect combinable with any of the previous aspects, the second material is softer than the first material.

In a fourth aspect combinable with any of the previous aspects, the second material is more frangible than the first material.

In a fifth aspect combinable with any of the previous aspects, the portion of the second hemispherical portion is a first portion, and the second hemispherical portion includes a second portion that includes the first material.

In a sixth aspect combinable with any of the previous aspects, the first and second portions of the second hemispherical portion are attached in the second hemispherical portion.

In a seventh aspect combinable with any of the previous aspects, the first and second portions of the second hemispherical portion are attached through a sintering or cryogenics process.

In an eighth aspect combinable with any of the previous aspects, the first material includes a nickel-chromium alloy, and the second material includes brass or bronze.

In a ninth aspect combinable with any of the previous aspects, the first material includes a nickel-chromium alloy, and the second material includes cast iron or non-metallic composite.

In a tenth aspect combinable with any of the previous aspects, the first hemispherical portion includes a portion that includes a third material different than the first material.

In an eleventh aspect combinable with any of the previous aspects, the third material and the second material are identical.

In a twelfth aspect combinable with any of the previous aspects, the portion of the first hemispherical portion that includes the third material extends from a surface of the first hemispherical portion adjacent the bore of the ball toward a surface of the first hemispherical portion adjacent the seating surface in the closed position.

In a thirteenth aspect combinable with any of the previous aspects, the portion of the first hemispherical portion that includes the third material approximates a cone.

In a fourteenth aspect combinable with any of the previous aspects, the third material is softer than the first material.

In another general implementation, a method of manufacturing a ball of a downhole ball valve includes: (a) positioning a spherical ball, the ball including a first material; (b) creating a bore through the ball, the ball including first and second hemispherical portions that define opposed circumferential portions of the bore; (c) creating a hole in the first hemispherical portion that extends from an outer surface of the ball, through the first hemispherical portion, and towards the bore; (d) filling at least a portion of the hole with a second material different than the first material; and (e) joining, in the first hemispherical portion, the second material with the first material filled in the hole.

In a first aspect combinable with the general implementation, the hole extends from the outer surface of the ball, through the first hemispherical portion, to the bore.

A second aspect combinable with any of the previous aspects further includes: (f) extending the hole from the bore into a portion of the second hemispherical portion of the ball.

In a third aspect combinable with any of the previous aspects, at least one of steps (c) or (f) is performed before step (b).

A fourth aspect combinable with any of the previous aspects further includes: (g) filling at least a portion of the hole that extends into the second hemispherical portion with a third material different than the first material.

A fifth aspect combinable with any of the previous aspects further include (h) joining, in the second hemispherical portion, the third material filled in at least the portion of the hole that extends into the second hemispherical portion with the first material.

In a sixth aspect combinable with any of the previous aspects, at least one of steps (g) or (h) is performed before step (b).

In a seventh aspect combinable with any of the previous aspects, the second and third materials are identical.

In an eighth aspect combinable with any of the previous aspects, the second material is softer than the first material.

In a ninth aspect combinable with any of the previous aspects, step (e) includes attaching the second material in the hole with the first material of the first hemispherical portion through a sintering or cryogenics process.

In a tenth aspect combinable with any of the previous aspects, the first material includes a nickel-chromium alloy, and the second material includes brass or bronze.

In another general implementation, a method for managing a downhole ball valve includes running a downhole ball valve into a wellbore. The downhole ball valve includes a ball that includes a first hemispherical portion, a second hemispherical portion, and a bore that extends through the ball between the first and second hemispherical portions. The first hemispherical portion includes a first material, and at least a portion of the second hemispherical portion that extends from a surface of the ball towards the bore of the ball includes a second material different than the first material. The method further includes adjusting the downhole ball valve to a closed position that closes the bore to fluid communication through the downhole ball valve; based on the downhole ball valve failing in the closed position, forming a hole through the second material of the second hemispherical portion and forming a hole through the first hemispherical portion; and establishing fluid communication through the formed holes of the hemispherical portions of the downhole ball valve while the ball valve is in the closed position.

In a first aspect combinable with the general implementation, the first hemispherical portion includes a portion that extends from the bore through the first hemispherical portion, the portion including the second material.

In a second aspect combinable with any of the previous aspects, forming a hole through the first hemispherical portion comprises forming the hole through the second material of the first hemispherical portion.

A third aspect combinable with any of the previous aspects further includes forming a hole through the first material of the first hemispherical portion.

In a fourth aspect combinable with any of the previous aspects, forming the hole through the second material of the first hemispherical portion includes at least one of: boring through the second material of the first hemispherical portion; drilling through the second material of the first hemispherical portion; or dissolving at least a portion of the second material of the first hemispherical portion to create the hole through the second material of the first hemispherical portion.

In a fifth aspect combinable with any of the previous aspects, the first hemispherical portion is positioned on a high pressure side of the downhole ball valve. and the second hemispherical portion is positioned on a low pressure side of the downhole ball valve.

In a sixth aspect combinable with any of the previous aspects, forming a hole through the second material of the second hemispherical portion includes at least one of: boring through the second material of the second hemispherical portion; drilling through the second material of the second hemispherical portion; or dissolving at least a portion of the second material of the second hemispherical portion to create the hole through the second material of the second hemispherical portion.

A number of implementations have been described. Nevertheless, it will be understood that various modifications may be made. For example, example operations, methods, and/or processes described herein may include more steps or fewer steps than those described. Further, the steps in such example operations, methods, and/or processes may be performed in different successions than that described or illustrated in the figures. As another example, although certain implementations described herein may be applicable to tubular systems (e.g., drillpipe and/or coiled tubing), implementations may also utilize other systems, such as wireline, slickline, e-line, wired drillpipe, wired coiled tubing, and otherwise, as appropriate. For instance, some implementations may utilize a wireline system for certain communications and a casing tubular system for other communications, in combination with a fluid system. Accordingly, other implementations are within the scope of the following claims.

What is claimed is:

1. A downhole ball valve comprising:

a housing that comprises a tubular member;

a ball seat positioned in the tubular member, the ball seat comprising a sealing surface; and a ball that comprises a first hemispherical portion, a second hemispherical portion, and a bore that extends through the ball between the first and second hemispherical portions, the ball adjustable between a closed position with the first hemispherical portion sealingly engaged with the sealing surface of the ball seat to close the bore to fluid communication with the tubular member, and an open position with the bore at least partially in fluid communication with the tubular member, the first hemispherical portion comprising a first material, and at least a portion of the second hemispherical portion extending from a surface of the ball towards the bore of the ball and comprising a second material different than the first material, the second material positioned in the ball so as to form a boreable or millable path through the ball to establish fluid communication through the valve as the valve is in the closed position.

2. The downhole ball valve of claim 1, wherein the portion of the second hemispherical portion of the ball extends through the second hemispherical portion from the surface of the ball to the bore of the ball.

3. The downhole ball valve of claim 1, wherein the portion of the second hemispherical portion of the ball approximates a truncated cone or fulcrum of a cone.

4. The downhole ball valve of claim 1, wherein the second material is softer than the first material, or the second material is more frangible than the first material, the second material selected from the group consisting of bronze, brass, and a non-metallic composite.

5. The downhole ball valve of claim 1, wherein the portion of the second hemispherical portion is a first portion, and the second hemispherical portion comprises a second portion that comprises the first material.

6. The downhole ball valve of claim 5, wherein the first and second portions of the second hemispherical portion are attached in the second hemispherical portion.

7. The downhole ball valve of claim 6, wherein the first and second portions of the second hemispherical portion are attached through a sintering or cryogenics process.

8. The downhole ball valve of claim 6, wherein the first material comprises a nickel-chromium alloy, and the second material comprises brass or bronze.

9. The downhole ball valve of claim 6, wherein the first material comprises a nickel-chromium alloy, and the second material comprises cast iron or non-metallic composite.

10. The downhole ball valve of claim 1, wherein the first hemispherical portion comprises a portion that comprises a third material different than the first material.

11. The downhole ball valve of claim 10, wherein the third material and the second material are identical.

12. The downhole ball valve of claim 10, wherein the portion of the first hemispherical portion that comprises the third material extends from a surface of the first hemispherical portion adjacent the bore of the ball toward a surface of the first hemispherical portion adjacent the seating surface in the closed position.

13. The downhole ball valve of claim 10, wherein the portion of the first hemispherical portion that comprises the third material approximates a cone.

14. The downhole ball valve of claim 10, wherein the third material is softer than the first material.

15. A method for managing a downhole ball valve, comprising:

running a downhole ball valve into a wellbore, the downhole ball valve comprising a ball that comprises a first hemispherical portion, a second hemispherical portion, and a bore that extends through the ball between the first and second hemispherical portions, the first hemispherical portion comprising a first material, and at least a portion of the second hemispherical portion that extends from a surface of the ball towards the bore of the ball comprises a second material different than the first material;

adjusting the downhole ball valve to a closed position that closes the bore to fluid communication through the downhole ball valve;

based on the downhole ball valve failing in the closed position, forming a hole through the second material of the second hemispherical portion and forming a hole through the first hemispherical portion by milling or boring through the second material in the second hemispherical portion and milling or boring through the first hemispherical portion; and establishing fluid communication through the formed holes of the hemispherical portions of the downhole ball valve while the ball valve is in the closed position.

16. The method of claim 15, wherein forming a hole through the second material of the second hemispherical portion comprises at least one of:

boring through the second material of the second hemispherical portion;

drilling through the second material of the second hemispherical portion; or dissolving at least a portion of the second material of the second hemispherical portion to create the hole through the second material of the second hemispherical portion.

* * * * *